United States Patent [19]

Gordon

[11] 4,029,207

[45] June 14, 1977

[54] CARRIER CARTON

[75] Inventor: Robert L. Gordon, Monroe, N.Y.

[73] Assignee: International Paper Company, New York, N.Y.

[22] Filed: Nov. 18, 1975

[21] Appl. No.: 632,929

[52] U.S. Cl. ..... 206/427; 229/40; 229/52 B

[51] Int. Cl.[2] ..... B65D 65/12; B65D 65/22; B65D 5/46

[58] Field of Search ..... 206/161, 162, 427, 434; 229/40, 51 D, 51 TS, 52 B, 52 BC, 17 G

[56] References Cited

UNITED STATES PATENTS

| | | | |
|---|---|---|---|
| 3,125,276 | 3/1964 | Zinn | 229/52 B X |
| 3,160,341 | 12/1964 | Cherney | 229/52 B X |
| 3,162,349 | 12/1964 | Kelly | 229/17 G |
| 3,167,214 | 1/1965 | Mahon | 229/40 X |
| 3,356,283 | 12/1967 | Champlin | 229/40 |
| 3,578,238 | 5/1971 | Schillinger et al. | 229/40 |
| 3,670,950 | 6/1972 | Rossi | 229/40 |
| 3,688,972 | 9/1972 | Mahon | 206/427 X |
| 3,692,232 | 9/1972 | Helms | 229/52 BC X |

*Primary Examiner*—Stephen Marcus

[57] ABSTRACT

An improved carrier carton is disclosed which is essentially closed to light having a top wall projecting beyond the upper portion of at least one of the end walls to provide a grippable projection. The projection is formed by an extending portion of the top wall folded downwardly upon itself at a score line to provide two layers of paperboard. The same portion of the blank extends downwardly from the inner corner of the projection thereby defining the upper portion of the end wall and includes a tear strip at the lower edge thereof so the carton can be easily opened. The projection preferably includes finger accepting openings.

10 Claims, 2 Drawing Figures

CARRIER CARTON

BACKGROUND OF THE INVENTION

This invention pertains to a carton for carrying a plurality of similar articles and, more particularly, relates to a carton for packaging a plurality of bottles containing a light sensitive product. Cartons for carrying bottles and the like are well-known in the prior art, such as, for example, as shown in patent U.S. Pat. No. 3,670,950. Also, a number of cartons have been developed for carrying light sensitive liquids, such as beer. Examples of such cartons are shown in patents U.S. Pat. No. 3,688,972; and U.S. Pat. No. 3,692,232. Such prior art cartons suffer from several serious deficiencies to which the present invention is addressed.

One deficiency of the prior art cartons is that they almost invariably contain openings, or finger grip accesses, through one of the major walls of the carton which enable light to enter to some extent. When light sensitive materials are packaged in the bottles contained by the carton, such light entry can seriously damage, or shorten the shelf life or, the packaged materials. Another serious disdvantage of the prior art cartons is that, almost invariably, the finger grip access openings are provided in the top wall of the carton, subjecting the sides of the openings to direct sheer forces when the carton is carried. These sheer forces dictate the use of a heavy weight board to ensure that the carton does not tear away from the customer's hand. In an effort to solve this problem some prior art cartons have included a double thickness of paperboard in the vicinity of the finger grips. However, each layer has been permitted to function independently of the other layer giving rise to the possibility that one layer alone could be subjected to the entire weight of the carbon and its contents. These deficiencies of the prior art have resulted in cartons of a significantly heavier weight paperboard than made possible by the present invention.

Another disadvantage of prior art cartons, which are to some extent meant to be closed to light, is that opening them usually involves either tearing away large sections of the carton or completely mutilating the carton so that it essentially ceases to function as a closable container once opened. As will be seen, one feature of the present invention includes provisions for easily opening the carton and reclosing same after part of the contents are removed.

SUMMARY OF THE INVENTION

In accordance with one aspect of the present invention there is provided a carrier carton which is essentially closed to light having a top wall which projects beyond at least the upper portion of the side walls to provide a grippable projection over the side wall. The projection includes at least an opening for accepting a human finger whereby the carrier can be lifted or carried. In a preferred configuration, the projection of the top wall is formed by an extension of the top wall folded downwardly upon itself at a score line to provide two layers of paperboard forming the projection.

Another aspect of the present invention comprehends a carrier carton having an end wall comprised of two flaps, a lower flap and an upper flap. The flaps meet each other in an obtuse angle at the line of intersection of the planes of the two flaps. The obtuse angle is formed interiorly of the carton. A tear away tab or strip is provided at the end of one of the two flaps wherein the tear strip is arranged in overlying relationship with respect to the other flap and is adhesively secured thereto. Thus, the tear strip is essentially external to the end wall where it is easily accessible for opening the carton without destruction of a major wall thereof.

In a preferred configuration, the upper flap is arranged to slope downwardly and outwardly defining an obtuse angle with the top wall of the carton, wherein the obtuse angle is formed interiorly of the carton and is measured as the angle between the inner surface of the upper flap and the inner surface of the top wall of the carton. In this configuration, the tear strip extends downwardly from the lower end of the upper flap and a score line is provided transverse to the upper flap so that the tear strip can be folded through a small angle and adhesively secured to the upper end of the lower flap.

Another aspect of the present invention comprehends a carrier carton having a top wall which projects beyond the upper portion of a side wall wherein the projection is formed as an extension of the paperboard forming the top wall and the extension is foled downwardly upon itself to define the projection. After forming the projection, the same portion or extension of the top wall paperboard continues downwardly forming the upper portion of the end wall. In a preferred configuration, the projection is provided with a pair of finger grip holes whereby the carton can be lifted, or carried, by a human. Also, in the preferred configuration, the above described upper portion, or panel, of the end wall is provided with a score line at the lower end thereof defining a tear strip. The tear strip is arranged to overlie a lower panel or flap of the end wall and is adhesively secured thereto.

In view of the foregoing, it is an object of the present invention to provide an improved carrier carton which is essentially closed to light.

It is another object of the present invention to provide a carrier carton having improved carrying characteristics and being made of relatively light weight paperboard.

It is another object of the present invention to provide a carrier carton having an improved easy opening feature.

It is yet another object of the present invention to provide a carrier carton having a strengthened finger grip provision whereby a lighter weight paperboard may be used to fabricate the carton.

It is yet another object of the present invention to provide a carrier carton having essentially no openings through any major wall thereof thereby achieving an essentially light tight carton.

These and other objects, advantages and features of the invention, will be more fully understood by referring to the following descriptions and claims taken in conjunction with the accompanying drawings.

BRIEF DESCRIPTION OF THE DRAWINGS

Referring now to FIG. 1 a carrier carton 10 is illustrated having a pair of opposed side walls, of which the near side wall 11 is shown in this perspective view. A top wall 12, and a near end wall 13, are shown. The side wall is comprised of a generally vertical lower side wall panel 14 and an upper side wall panel 15 which slopes inwardly. The end wall 13 includes an end wall lower flap 16 which, as will be seen in the discussion in reference to FIG. 2, extends from the bottom wall portion of the blank. The end wall also includes an end wall upper flap 17 which is a continuation of the top wall portion of the blank. A tear strip, or pull tab, 18 is provided which extends from the lower edge of the end wall upper flap 17 at a score line 19.

Figure 1:
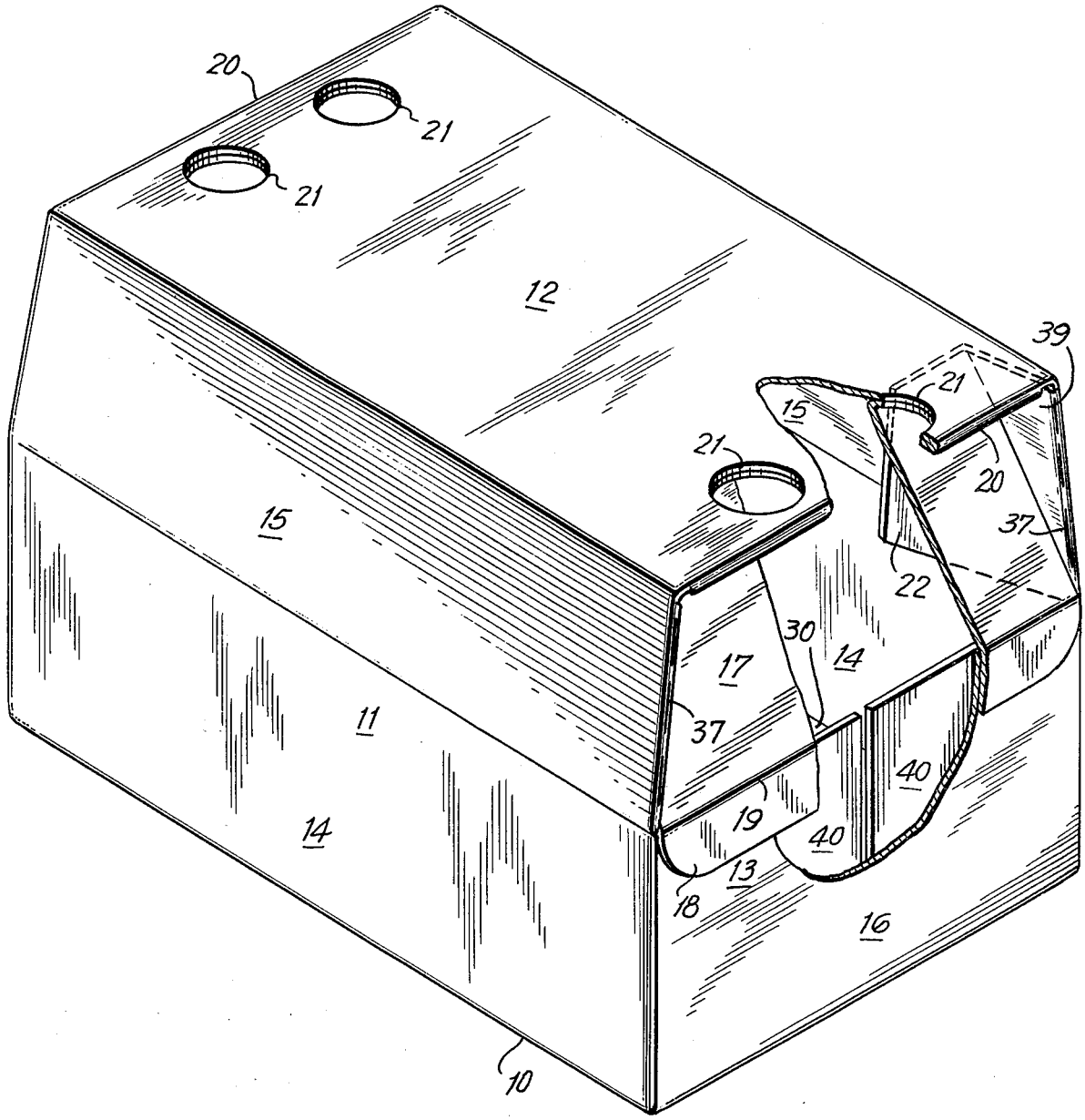
FIG. 1 is a perspective view, partly in section, of a carrier carton illustrating features of the present invention.

The top wall 12 extends over the end wall upper flap 17, by an eave-like projection 20. The upper surface of the projection 20 is a continuation of the top wall 12 but, as can be seen, is outboard, or in overhanging relationship, to the end wall of the carton. The projection 20 consists of two layers of paperboard adhesively secured together. The lower layer is formed by a continuing extension of the upper wall folded downwardly upon itself on a score line which forms the end of the top wall. Therefore, the lower surface of the projection 20 is the same face of the blank as the upper surface of the top wall 12. The same face of the blank continues downwardly and forms the end wall upper flap 17. Extending from the lower edge of the end wall upper flap is the tear strip, or pull tab, 18 which is secured, by a conventional adhesive, to the exterior upper portion of the end wall lower flap 16. A pair of finger grip openings 21 is provided through each of the projections 20. It can be seen that light passing through the openings 21 will not enter the carton.

The upper side wall panel 15 and the end wall upper flap 17 slope downwardly and outwardly from the top wall 12 to a generally rectangular base portion formed by the lower side wall panel 14 and the end wall lower flap 16. This configuration is preferred to more firmly hold the bottles to be packaged by the present carton which have the conventionally reduced neck portion and enlarged base portion, typical of commonly used beer bottles. Accordingly, it can be seen that the end wall upper flap 17 meets the end lower flap 16 at an angular relationship which can be defined as an obtuse angle measured interiorly of the carton, namely, between the inner surfaces of the end wall upper flap 17 and the end wall lower flap 16. Likewise, an obtuse angle is formed interiorly of the carton, between the inner surface of the top wall 12 and the inner surface of the end wall upper flap 17.

A gusset flap 22 is provided as an extension of the upper side wall panels 15. The gusset flap 22 is arranged to tuck in behind the end wall upper flap 17 and performs the function of minimizing light leaks along the edges of the end wall upper flap 17 particularly, in the region of those edges near the top wall.

When bottled liquids are to be packaged it is preferred that conventional divider panels, not shown, made of appropriate weight paperboard, be used at least in the lower portion of the carton and between each row and column of bottles to minimize bottle breakage.

Figure 2:
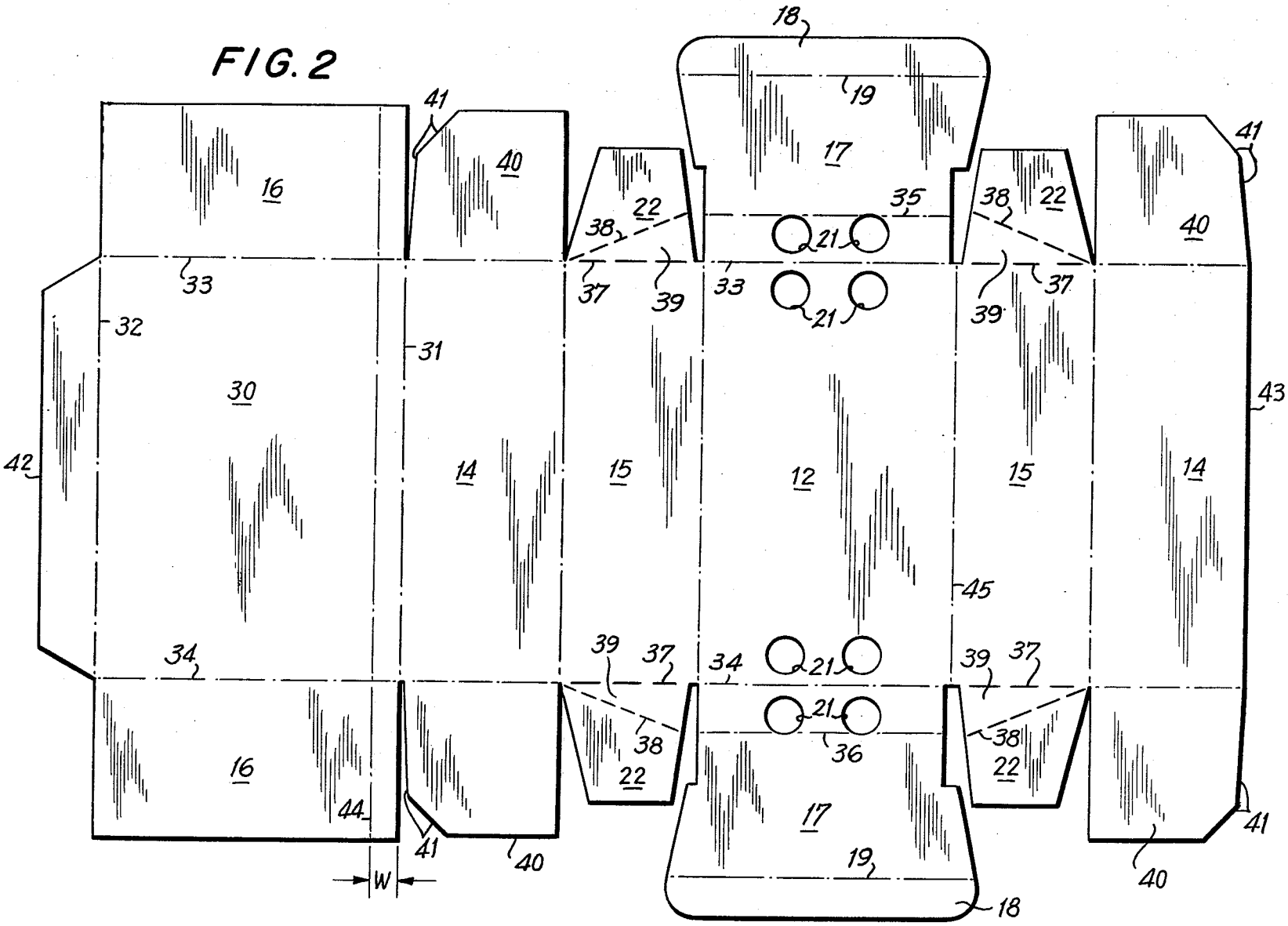
FIG. 2 is a plan view of a flat blank which can be used to erect the carton illustrated in FIG. 1.

Referring now to FIG. 2 which is a plan view of a flat blank which can be used to erect the carton illustrated in FIG. 1, the top wall 12, the upper side wall panels 15, and the lower side wall panels 14, are shown formed by a series of parallel transverse score lines. Also shown is a bottom wall 30 formed in the blank by parallel transverse score lines 31, 32. The end wall lower flaps 16 are shown connected with the bottom wall 30 by longitudinal score lines 33, 34 which respectively extend for the full length of the blank. Joined to the top wall 12, by the score lines 33, 34 respectively, are the end wall upper flaps 17.

A pair of longitudinal score lines 35, 36 are provided in the respective end wall upper flaps 17 to define the fold line from which the end wall upper flaps depend from the eave-like projection of the top wall. The portion of the flaps 17 between these respective score lines 33, 35 and 34, 36 are both folded downwardly and adhesively secured to the respective adjacent ends of the top wall 12. Aligned openings 21 are provided to form the two finger grip openings at each end of the eave-like projection. The score lines 19 are shown longitudinally near the ends of the flaps 17 defining the narrow tear strips or pull tabs 18 each of which is at the end of the respective flaps 17.

Four gusset flaps 22 are shown respectively joined with the upper side wall panels 15 by score lines 33, 34 in which perforations 37 are provided. A diagonal perforated score line 38 is provided in each of the gusset flaps 22 thereby providing a triangular gusset segment 39, in each of the respective gusset flaps. The perforations 37 are preferably one-half inch in length spaced one-half inch apart. The perforations of the line 38 are preferably one-quarter inch in length spaced one-quarter inch apart.

Referring to FIG. 1, it can be seen that, in the erected carton, the triangular gusset segments 39 will be parallel to that portion of the respective adjacent upper side wall panel 15 which extends beyond the respective end wall upper flap 17, and will be firmly held in that position by the end wall upper flap 17. The gusset flaps 22 perform the key function of minimizing or eliminating light entry from the upper corners of the end wall flaps 17 and along the edges of same. As shown in FIG. 2, gusset flaps 22 are provided with angular transverse edges to facilitate their being tucked in behind the end wall upper flaps 17 when the carton is erected.

Referring again to FIG. 2, lower end wall minor flaps 40, are provided, extending from each end of the lower side wall panels 14. The edges of the end wall minor flaps 40 nearest the bottom wall 30 are angularly cut back at 41, to facilitate their easy passage over the end wall lower flaps 16 when the carton is erected.

A glue flap 42 is provided extending from the side score line 32 of the bottom wall 30. When the carton is erected the glue flap 42 is adhered to the inner surface of the distant lower side wall panel 14, so that the edge 43 of the latter panel is in registry with the score line 32. A redundant, or extra, transverse score line 44, is provided, passing through the bottom wall 30 and the end wall lower flaps 16 at a distance W from the score line 31. The score line 44 is not essential to the completed carton. However, it is provided as an important convenience to enable the carton blank to be shipped in a flat tubular form to the packaging consumer. The purpose of the score line 44 can be more easily understood by noting that the width of the top wall 12 is less than the width of the bottom wall 30 in order to provide a sloping condition of the upper side wall panels 15. The dimension W, being the distance between score lines 31 and 44, is equal to one-half the difference the widths of the top wall 12 and bottom wall 30, so that when the glue flap 42 is adhesively secured to the distant lower side wall panel 14, the tube thus formed, can be layed flat. The flat tube will have one fold at the score line 44 and a second fold at the score line 45 defining the upper corner of the top wall which is diagonally opposite the corner of the erected carton defined by the score line 31.

Referring again to the end wall construction of the erected carton, the end wall lower flaps 16 form the lower outer surface of the end walls. Behind those flaps are the end wall minor flaps 40 which are initially formed by being folded prior to the folding of the end wall lower flaps 16. No adhesive connection is required between the flaps 16, 40. It is preferred that only the end wall upper flaps 17 be adhesively secured to the respective end wall lower flaps 16 at the pull tab 18, so that when the tab is opened the entire carton end is openable.

While the invention has been described with a certain degree of particularity, it can nevertheless be seen, by those of general skill in the art, that many variations and modifications of the invention can be made without departing from the true spirit and scope thereof.

I claim:

1. A carrier carton, for packaging a plurality of similar articles, formed from an essentially flat blank of paperboard, comprising:

a. an opposed pair of end walls;

b. an opposed pair of side walls;

c. a top wall;

d. a bottom wall;

e. each of said walls being foldably connected along a score line with at least a portion of at least one other adjacent wall of said walls to form said essentially flat blank when said carton is in the unerected condition;

said top wall extending beyond at least the upper portion of the first of said end walls defining an eave-like projection of said top wall over said upper portion of said first end wall when said carton is in the erected condition;

g. said eave-like projection including an opening therethrough sufficiently large to accept a human finger, said opening passing essentially only through said projection whereby light is essentially prohibited from entering said carton and said carton may be lifted by use of said opening, said eave-like projection being comprised of two layers of said paperboard wherein the lowermost layer of said two layers is formed from an extension of said top wall folded downwardly upon itself along a score line to define the lower surface of said eave-like projection; and h. at least the first of said end walls including two flaps, a first of said flaps defining at least part of the upper portion of said first end wall, the second of said flaps defining at least part of the lower portion of said first end wall, said flaps meeting each other in said end wall, and one of said flaps including a pull tab connected with the end thereof by a score line, said pull tab overlying the other of said flaps and being adhesively secured thereto.

2. A carrier carton according to claim 1 wherein said two layers of said paperboard forming said eave-like projection are adhesively secured together.

3. A carrier carton according to claim 2 further comprising a second eave-like projection of said top wall, said second projection extending beyond at least the upper portion of the second end wall, said second projection being formed from an extension of said top wall folded downwardly upon itself along a score line and said folded extension being adhesively secured to the lower surface of the unfolded portion of said extension, whereby said second projection is comprised of two layers of said paperboard, said second projection including an opening passing essentially only through both layers thereof and being sufficiently large to accept a human finger.

4. A carrier carton according to claim 3 wherein each of said projections includes a second opening essentially only through both respective layers thereof.

5. A carrier carton according to claim 4 wherein said first flap of said first end wall extends downwardly from said top wall and slops outwardly whereby an obtuse angle is formed interiorly of said carbon between said top wall and said first flap.

6. A carrier carton according to claim 5 wherein said second flap extends upwardly from said bottom wall at a right angle thereto and wherein said pull tab extends downwardly from the lower end of said first flap and is connected therewith by said score line.

7. A carrier carton, for packaging a plurality of similar articles, formed from an essentially flat blank of paperboard, comprising:

a. an opposed pair of end walls;

b. an opposed pair of side walls;

c. a top wall;

d. a bottom wall;

e. each of said walls being foldably connected along a score line with at least a portion of at least one other adjacent wall of said walls to form said essentially flat blank when said carton is in the unerected condition;

f. the upper portions of each of said end walls and said side walls sloping downwardly and outwardly from said top wall thereby each of said upper portion forms an obtuse angle interiorly of said carton with said top wall;

g. said top wall extending beyond at least the upper portion of the first of said end walls defining an eave-like projection of said top wall over said upper portion of said first end wall when said carton is in the erected condition;

h. said eave-like projection including an opening therethrough sufficiently large to accept a human finger, said opening passing essentially only through said projection whereby light is essentially prohibited from entering said carton and said carton may be lifted by use of said opening, said eave-like projection being comprised of two layers of said paperboard wherein the lowermost layer of said two layers is formed from an extension of said top wall folded downwardly upon itself along a score line to define the lower surface of said eave-like projection; and i. at least the first of said end walls including two flaps, a first of said flaps defining at least part of the upper portion of said first end wall, the second of said flaps defining at least part of the lower portion of said first end wall, said flaps meeting each other in an obtuse angle, and one of said flaps including a pull tab connected with the end thereof by a score line, said pull tab overlying the other of said flaps and being adhesively secured thereto.

8. A carrier carton according to claim 7 wherein said two layers of said paperboard forming said eave-like projection are adhesively secured together.

9. A carrier carton according to claim 8 further comprising a second eave-like projection of said top wall, said second projection extending beyond at least the upper portion of the second end wall, said second projection being formed from an extension of said top wall folded downwardly upon itself along a score line and said folded extension being adhesively secured to the lower surface of the unfolded portion of said extension, whereby said second projection is comprised of two layers of said paperboard, said second projection including an opening passing essentially only through both layers thereof and being sufficiently large to accept a human finger.

10. A carrier carton according to claim 9 wherein each of said projections includes a second opening essentially only through both respective layers thereof.

* * * * *